US005375914A

United States Patent [19]

Donnelly

[11] Patent Number: 5,375,914

[45] Date of Patent: Dec. 27, 1994

[54] PUBLIC SEATING CHAIR

[75] Inventor: Philip K. Donnelly, Barto, Pa.

[73] Assignee: J. G. Furniture Systems, Inc., Quakertown, Pa.

[21] Appl. No.: 882,159

[22] Filed: May 12, 1992

[51] Int. Cl.[5] ..... A47C 1/12

[52] U.S. Cl. ..... 297/335; 297/440.2; 297/452.18

[58] Field of Search ..... 297/331, 335, 440.20, 297/440.21, 452.18

[56] References Cited

U.S. PATENT DOCUMENTS

| | | | |
|---|---|---|---|
| 2,652,881 | 9/1953 | Rowe | 297/440.20 |
| 3,098,677 | 7/1963 | Williams | 297/335 |
| 3,813,149 | 5/1974 | Lawrence, III et al. | 297/335 |
| 3,850,476 | 4/1974 | Day | 297/335 |
| 4,898,425 | 2/1990 | Mundy | 297/440.20 |
| 5,100,204 | 3/1992 | Makimara et al. | 297/440.20 |

OTHER PUBLICATIONS

Brochure entitled "Seating Concepts", various dates.
Brochure entitled "American Desk-Public seating" by Seating Concepts, 1989.
Brochure entitled "American Seating" by American Seating Company, 1989.
Brochure entitled "Auditorium Seating" by JG Furniture Systems, Inc. 1985.
Brochure entitled "JG Furniture Systems Auditorium Seating" by JG Furniture Systems, Inc. 1987.
"Seating Concepts-Auditorium, Public, Contract and Classroom Seating", Seating Concepts brochure Catalog Excerpt with public seating available from various manufacturers.
"Auditorium, Theatre, Arena, Stadium, Lecture Room", American Seating Architectural Products Group brochure (1989).
"JG Furniture Systems Auditorium Seating" brochure (1987).
"Auditorium Seating", JG Furniture Systems, Inc. brochure (1985).

*Primary Examiner*—Alexander Grosz
*Attorney, Agent, or Firm*—Nixon & Vanderhye

[57] ABSTRACT

A fixed public seating construction includes welded structural steel frame assemblies, each of which includes a standard, a floor mount plate, a seat support or mounting bracket, a back support or mounting bracket, and an arm rest support, all welded together at the manufacturing plant as a single unit. The public seating construction also incorporates relatively rigid plastic shell type seat and back components which will accommodate (on their "back" or non-use sides) optional inserts of wood, laminate, fabric, etc. Both the back and seat components are comprised of unitized, blow molded shells, filled with foam. In addition, both have mounting assemblies which include steel mounting inserts fixed in place during the blow molding operation, as well as associated support bars which are fastened to the inserts in overlying relationship, prior to shipping. Both the back and seat components have "drop-in" mounting features, and a free floating hinge is also provided for mounting the seat to the frame.

18 Claims, 16 Drawing Sheets

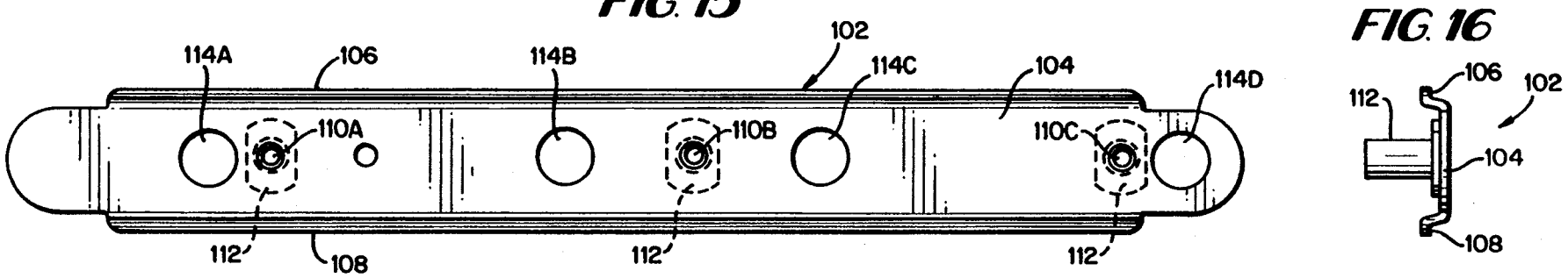
FIG. 15
FIG. 16
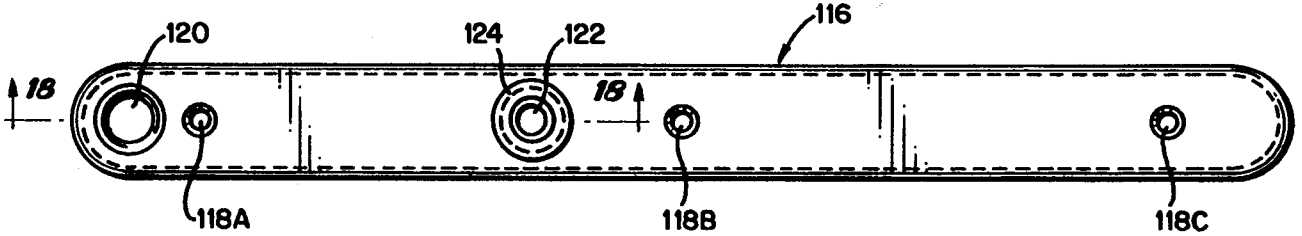
FIG. 17
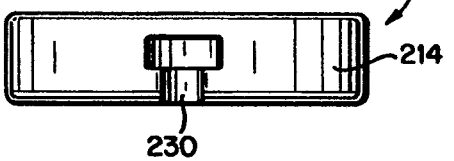
FIG. 30
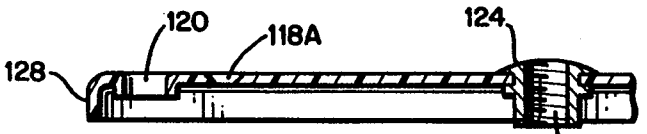
FIG. 18
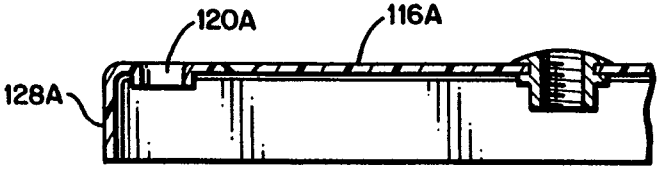
FIG. 18A 170
174
171

192
190
180C
188
178

192A
178A 176D
172C
176C
170
172B
176B
171
176A
172A 27
184
188
180C
27
178
180B
182
180A
186

238
238B 238B
240
238A
238

PUBLIC SEATING CHAIR

BACKGROUND AND SUMMARY OF THE INVENTION

The present invention relates generally to chair constructions and, more specifically, to fixed seating for auditoriums, lecture halls, theaters, stadiums, and other fixed "public seating" applications.

Conventional fixed seating arrangements are often relatively complex in terms not only of construction but also in terms of assembly and installation. For example, there are known fixed seating constructions in which the seat and back components cannot be fully assembled until various internal adjustments are made at the time of installation. It will be readily appreciated that this kind of arrangement, with many parts and fasteners to be accounted for and assembled at the site, is costly and inefficient in terms of manufacturing, shipping and installation.

In various known fixed seating constructions, seat components also incorporate spring-type cushions which sag, squeak and which ultimately must be replaced. It is also often the case that the seat and back cushions are provided with internal, rigid frames which may cause wear points or even holes in the upholstery fabric covering the cushion frames.

The present invention provides a unique fixed seating construction which eliminates the above noted problems (as well as others) associated with conventional fixed seating arrangements.

Specific features of the invention include welded structural steel frame assemblies which provide improved strength over mechanically joined frames, and which easily accommodate installation on flat, sloped or stepped floors. Each frame assembly includes a standard, a floor mount plate, a seat support or mounting bracket, a back support or mounting bracket, and an arm rest support, all welded together at the manufacturing plant as a single unit. These welded frame assemblies do not fracture and break in the manner of conventional castings. The welded steel frame assemblies thus provide increased strength and durability while reducing the chances for injury which can occur with a sudden fracture or break.

The present invention also incorporates relatively rigid plastic shell type seat and back components which will accommodate (on their "back" or non-use sides) optional inserts of wood, laminate, fabric, etc. The components are comprised of unitized, blow molded shells, and the seat component is filled with foam (preferably rigid polyurethane) for added strength and rigidity. In addition, both have mounting assemblies which include steel mounting inserts fixed in place during the blow molding operation, as well as associated support bars which are fastened to the inserts in overlying relationship, prior to shipping. In this way, the seat and back components may be essentially finished at the manufacturing site and need only be mounted to and between a pair of adjacent frame assemblies (with a minimum number of fasteners) at the installation site, greatly reducing the time and cost of installation.

The use of plastic seat and back shells as described has additional advantages including: (1) integral coloring which won't chip or scratch like painted steel; (2) impact resistance; and (3) overall reductions in the number of parts, fabrication operations, maintenance and safety hazards.

The seat and back components are configured for "drop in" installation on the frame assemblies, as described in greater detail herein, which further simplifies installation by reducing the number of parts, fasteners, and installation tools required.

With respect to the back component, a pair of back support bars located on either side of the back component are provided with a pair of specially designed bolts which extend laterally away from the back component in the manner such that the lower pair of bolts may be drawn upwardly into downwardly opening grooves formed in the back mounting brackets, and the upper pair of bolts may then be rotated into bolt receiving recesses formed at the upper ends of the back mounting brackets and secured in place by a pair of impact modified, rigid nylon inserts.

Another feature of the invention relates to a unique hinge construction for the seat component which permits the above mentioned "drop-in" feature. The hinge, preferably of nylon construction, is a free floating unit which is self-lubricating and provides a clean, non-mechanical appearance.

More specifically, the hinge is designed to freely rotate on a hinge pin fixed to the seat support bracket of the frame assembly. The hinge is formed with a T-shaped slot adapted to receive a bolt head. The bolt head in this instance is part of another specially designed bolt which extends laterally out of the seat component and which may be dropped into the T-shaped slot. The hinge is also provided with a threaded aperture which is designed to threadably receive a bolt having a smooth distal shank portion which is receivable within an aperture provided in the seat mounting assembly. In this way, the hinge remains in free floating relationship relative to both the frame assembly seat mounting bracket and the seat component itself. Additional details with respect to the hinge construction are provided further herein.

The seat component also features an automatic counterweight return which brings the seat to an upright position when not in use. The counterweight is provided by a dense, particulate material loaded into the seat shell and properly located prior to the injection of the rigid polyurethane foam. This arrangement eliminates conventionally used springs (which are prone to fatigue failure) and essentially eliminates all maintenance of the counterweight automatic return arrangement.

Other features of the present invention relate to the use of adhesively secured foam cushions which provide increased comfort and which contain no moving parts such as serpentine coil springs which tend to deteriorate over time. The foam cushion feature also facilitates the application of upholstery fabric which in accordance with this invention, is set over the foam cushion (both seat and back) and pressed into a peripheral groove. A flexible female strip (preferably extruded polyethylene) is then pressed into the groove and the fabric is stapled through the strip to the underlying shell. A flexible male strip of similar material is then pushed into the female strip to thereby hide the staples and to otherwise provide a clean, streamlined and attractive appearance. The manner of application of the upholstery eliminates sewing and slip on constructions as well as seams and welts, thereby even further reducing costs and maintenance.

Thus, in accordance with one aspect of an exemplary embodiment of the invention, there is provided a chair comprising a frame including a pair of standards each including a seat mounting bracket and a back mounting bracket, each seat mounting bracket having a hinge pin; a seat component pivotally mounted on a pair of the hinge pins by means of a pair of hinges, each hinge comprising a main body portion freely rotatably mounted on one of the hinge pins, the main body portion also formed with a slot for receiving a bolt head of a first bolt threadably secured to the seat component.

In a related aspect, the invention provides a a chair comprising a frame including a pair of back mounting brackets and a pair of seat mounting brackets; a seat component mounted on and between the seat mounting brackets; and a back component mounted on the back mounting brackets wherein the back component includes an upper pair of laterally extending mounting pins and a lower pair of laterally extending mounting pins, the pair of back mounting brackets having surfaces for receiving the pair of upper and lower mounting pins in a substantial vertical load bearing relationship such that the back component is hung on the frame.

In another aspect, the invention provides a chair seat component comprising a one-piece plastic shell having upper and lower surfaces connected by a peripheral end wall, to thereby create an interior space; a pair of metal inserts molded in place within opposite portions of the peripheral end wall, the metal inserts each having at least one aperture therein for threadably receiving a seat mounting element therein; and wherein at least a portion of the interior space is filled with foam.

In still another aspect, the invention provides a chair back component comprising a one-piece plastic shell having front and back surfaces connected by a peripheral end wall, to thereby create an interior space; a pair of metal inserts molded in place within opposite portions of the peripheral end wall, the metal inserts each having at least one aperture therein for threadably receiving a back mounting element therein.

In still another aspect, the invention provides a chair component comprising a unitary shell having a groove extending about a peripheral portion thereof; a cushion secured to the shell within an area inside the groove; fabric applied over the cushion and secured within the groove; and an elongated strip pressed into the groove overlying the fabric.

The invention also relates to a method of forming a chair component comprising the steps of a) blow molding a plastic shell having first and second surfaces connected by a peripheral end wall to thereby create an interior space, and wherein the first and second surfaces are welded to each other at a plurality of locations within an area defined by the peripheral end wall;

b) during step (a), blow molding in place a pair of metal inserts within opposite side portions of the peripheral end wall; and c) injecting at least a portion of the interior space with foam.

It will thus be appreciated that the present invention provides a fixed seating construction where function, durability, economy and style are combined into a single product which provides the enumerated benefits and advantages. Additional objects and advantages will become apparent from the detailed description which follows.

BRIEF DESCRIPTION OF THE DRAWINGS

FIG. 15 is a side elevation of an insert for the seat shell in accordance with the invention:

FIG. 16 is an end view of the insert illustrated in FIG. 15;

FIG. 17 is a side elevation of a seat support bar in accordance with the invention;

FIG. 18 is a partial section of the seat support bar illustrated in FIG. 17 and taken along the line 18—18;

FIG. 18A is a partial section of an alternative seat support bar in accordance with another exemplary embodiment of the invention;

FIG. 30 is a top plan of the hinge illustrated in FIGS. 28 and 29;

DETAILED DESCRIPTION OF THE DRAWINGS

Figure 2:
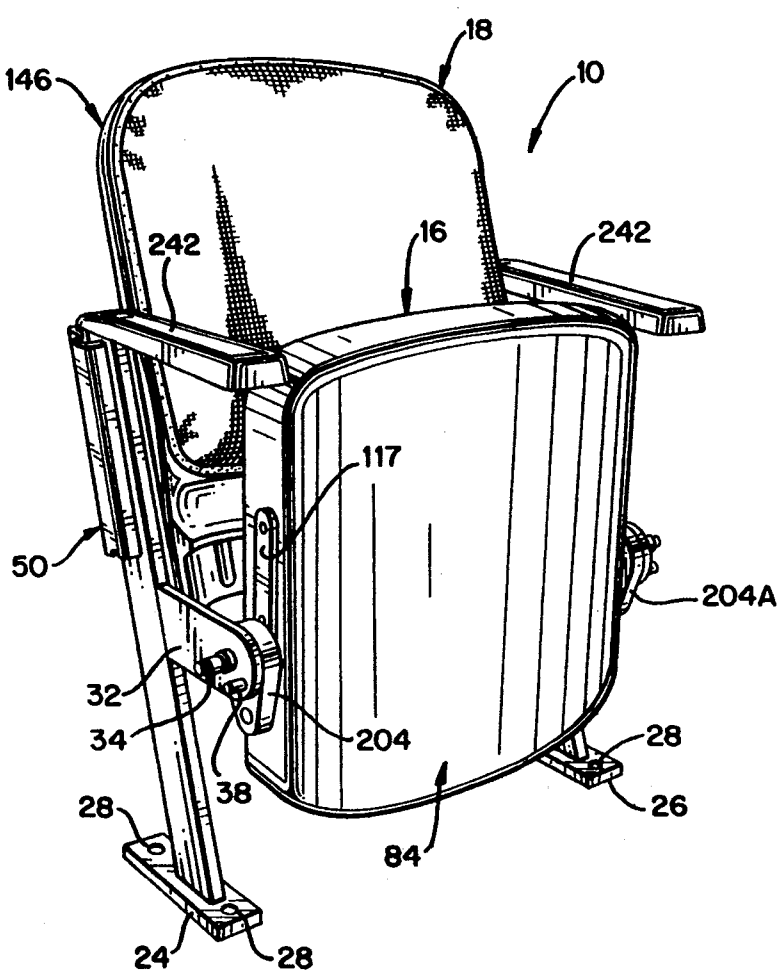
FIG. 2 is a perspective view similar to FIG. 1 but with the seat component pivoted to a non-use position.
Figure 1:
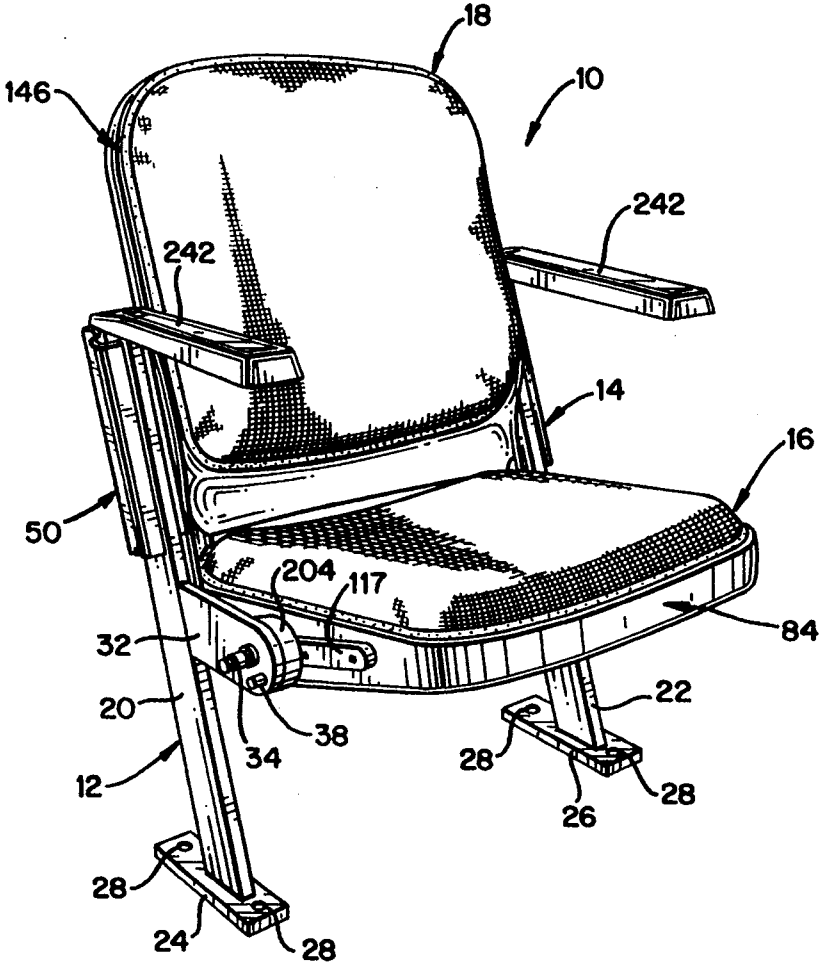
FIG. 1 is a perspective view of a chair in accordance with an exemplary embodiment of the invention, with the seat component in an in-use position.

The chair construction in accordance with an exemplary embodiment of the invention is shown fully assembled at 10 in FIGS. 1 and 2, and generally includes a pair of frame assemblies 12 and 14, a seat 16 and a back 18. As best seen from these Figures, the seat component 16 is movable between a use position shown in FIG. 2, the non-use position being the normal position for the seat. The details of each of these major components are described in greater detail below.

FRAME CONSTRUCTION

Figure 3:
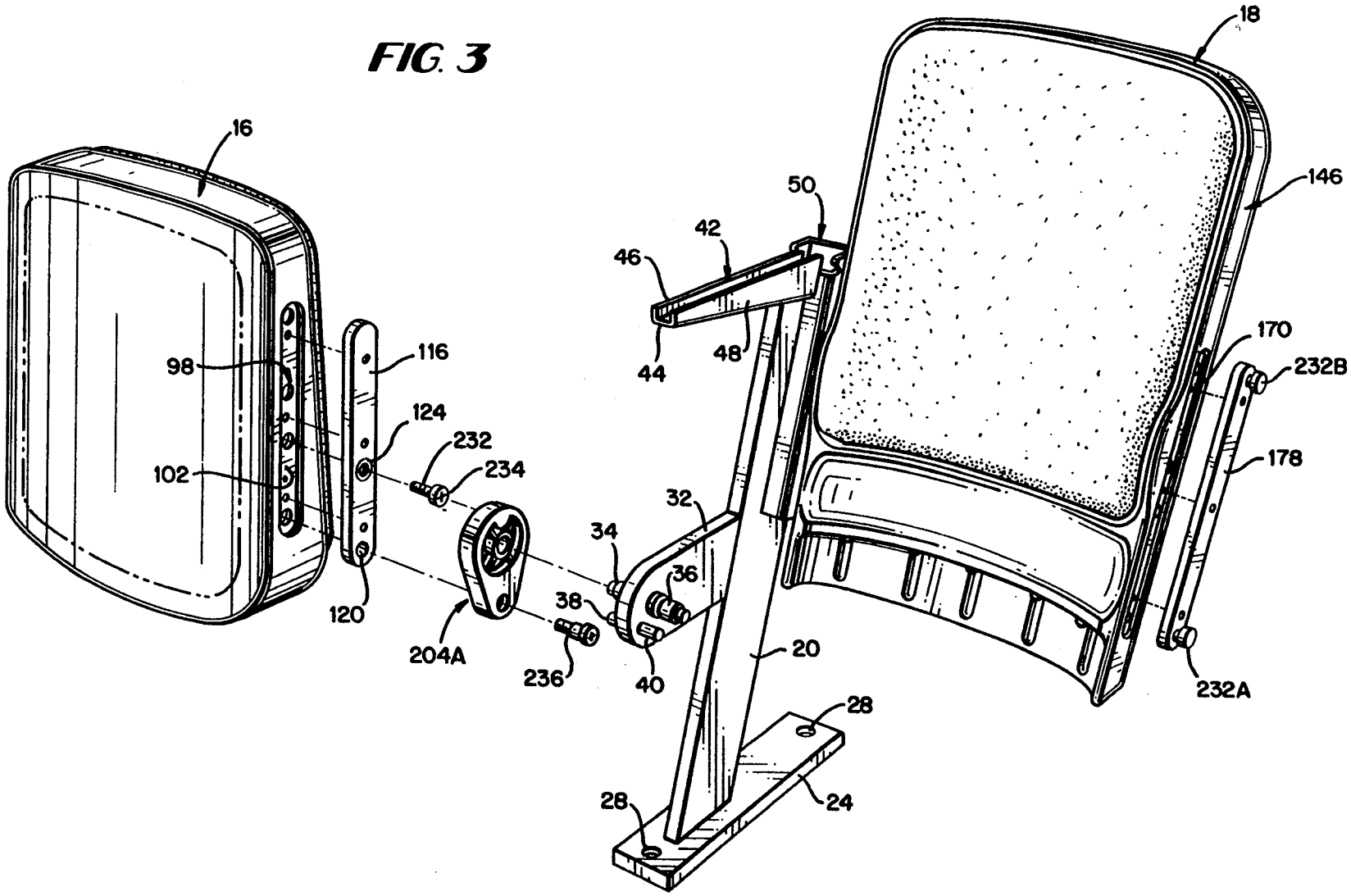
FIG. 3 is a partial exploded view of chair components of the type used in the chair construction illustrated in FIGS. 1 and 2.
Figure 5:
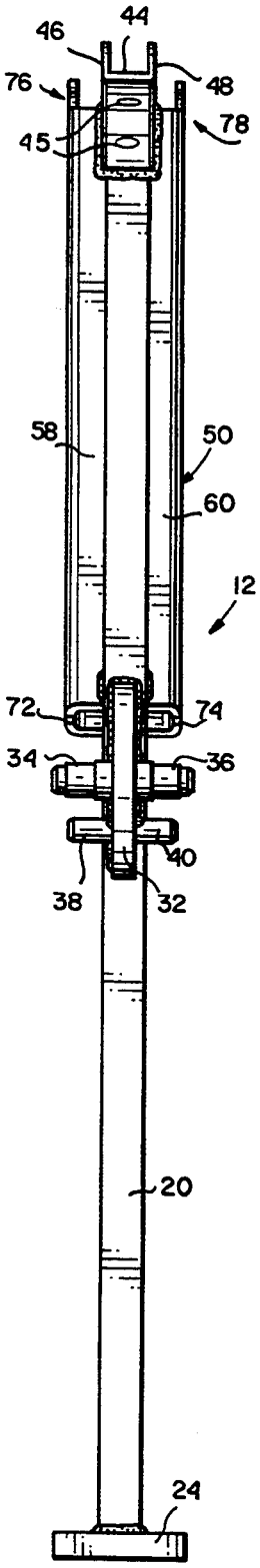
FIG. 5 is a front elevation of the frame assembly illustrated in FIG. 4.
Figure 4:
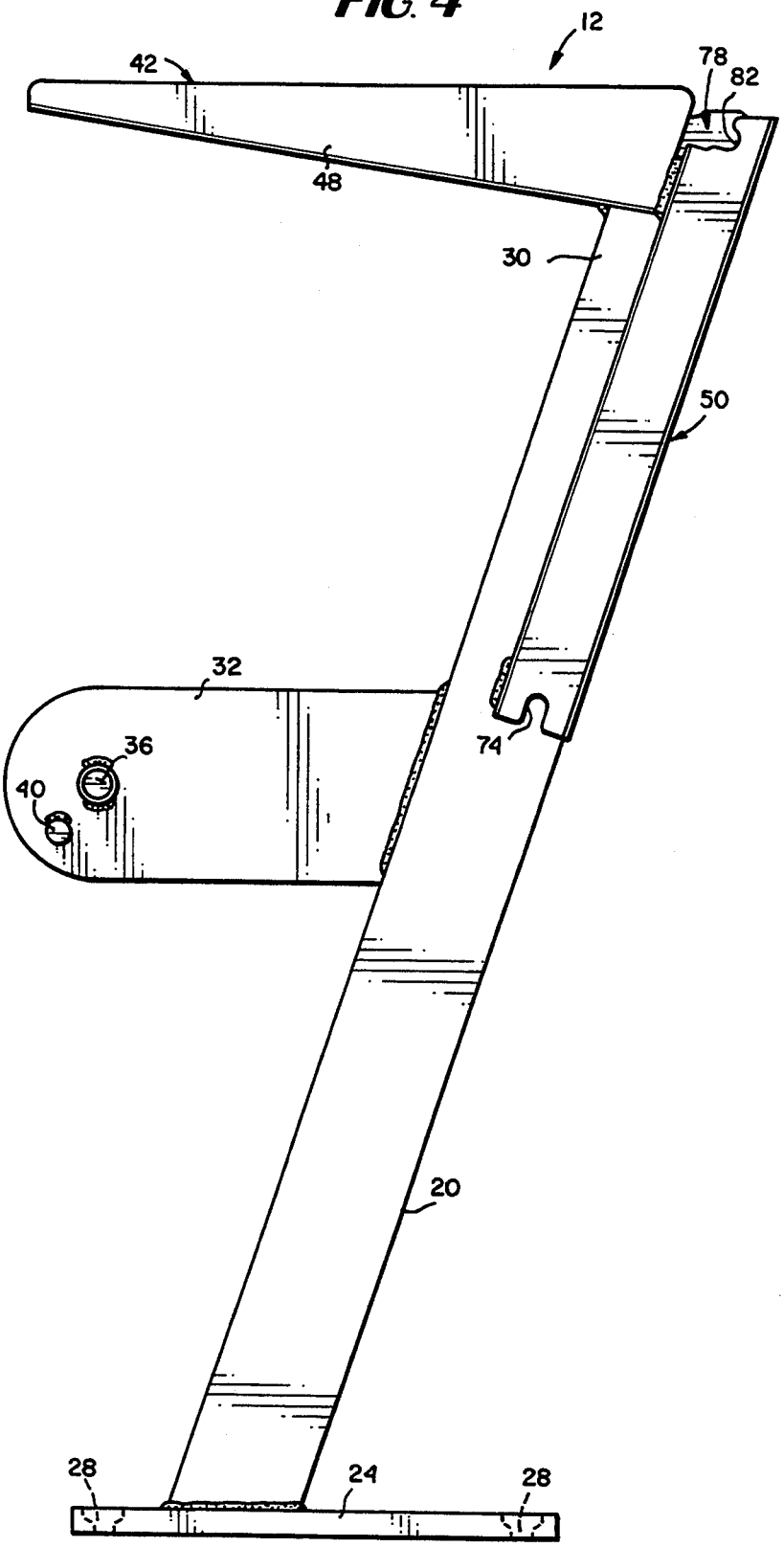
FIG. 4 is a side elevation of a frame assembly of the type used in the chair construction illustrated in FIGS. 1–3.
Figure 6:
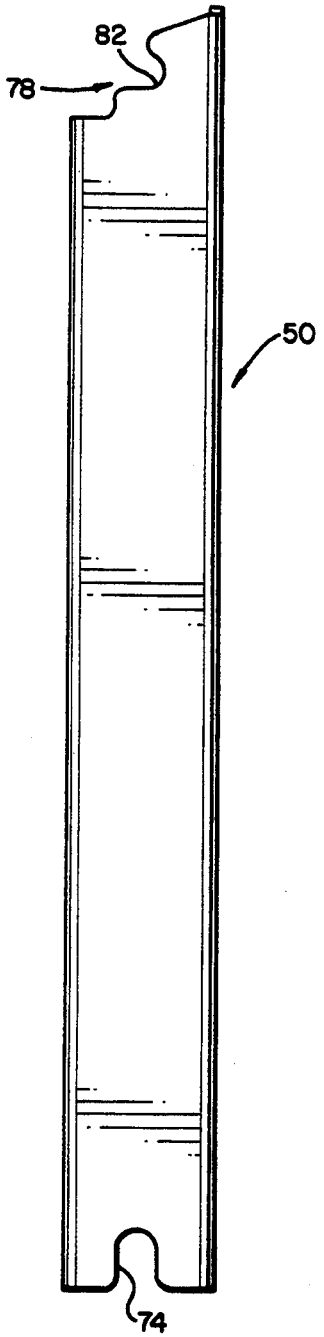
FIG. 6 is a side view of a back mounting bracket of the type utilized in the chair construction illustrated in FIGS. 1–3.
Figure 7:
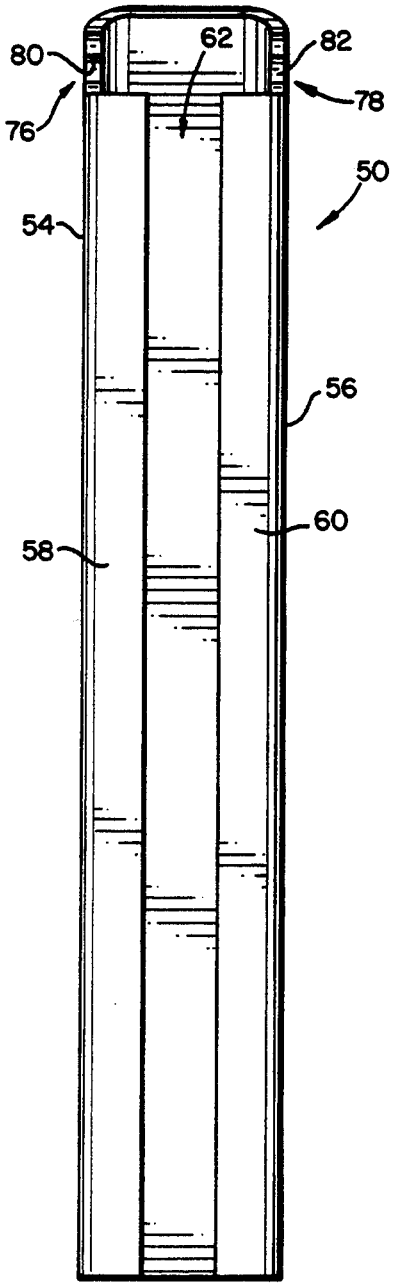
FIG. 7 is a front elevation of the back mounting bracket illustrated in FIG. 6.

With further reference to FIGS. 3–5 as well as FIGS. 1 and 2, the chair frame assemblies 12, 14 in accordance with an exemplary embodiment of the invention include generally a pair of structural steel tubes or standards 20 and 22 of rectangular cross-section. Floor mount base plates 24 and 26 (also preferably steel), respectively, are welded to the lower ends of the standards and are provided with fastener apertures 28 by which the chairs are secured to a floor or other supporting surface.

The frame assemblies 12 and 14 are essentially identical with the obvious exception that one is on the left and the other is on the right of the chair seat 16 and back 18. Minor differences also appear in the frame assembly which is at the end of a row of similar chairs. These minor differences will be noted further below. In any event, for the sake of brevity, only one frame assembly, i.e., frame assembly 12, will be described in detail, it being apparent that the right and left hand frames are mirror images of each other, and that the function, manner of operation, and assembly procedures for one are the same for the other.

It will be appreciated especially from FIG. 4 that standard 20 of frame assembly 12 assumes an angle relative to vertical when mounted to the floor or other supporting surface. In a preferred arrangement, the standard is inclined rearwardly about 15° (preferably 18°) relative to vertical. It will be appreciated however that standard 20 may be modified, for example, to accommodate an inclined or a stepped floor arrangement where the chair standards are fastened to substantially vertical risers.

At a location approximately midway between the floor mount plate 24 and the upper end 30 of the standard 20 is a seat support bracket or plate 32 which is welded to the standard 20. The bracket or plate 32 extends forwardly of the standard, substantially parallel to the floor, and is provided with a pair of hinge pins 34, 36 (or a single pin extending through the bracket 32) which extend in opposite directions away from the seat support bracket 32. A pair of stop pins 38, 40 are also welded to the bracket or plate 32 in a location below and forward of the hinge pins 34. 36. The function of the hinge and stop pins will be described in greater detail below.

An arm support bracket 42 (see FIGS. 3–5) is welded to the standard 20 at the upper end 30 thereof. The arm support bracket 42 also extends forwardly, in substantially the same vertical plane and substantially parallel to the seat support bracket 32. The arm support bracket 42 comprises a substantially U-shaped channel having a base 44 and a pair of side walls 46, 48. The base 44 inclines downwardly from front to rear and, as best seen in FIG. 4, terminates short of the side walls 46, 48 at the rearward end of the bracket 42 so that the side walls 46, 48 will overlap the standard 20 to facilitate and strengthen the welded joint. The base 44 is provided with a pair of apertures 45 (see FIG. 5) which facilitate mounting of an arm rest as described further below.

Figure 8:
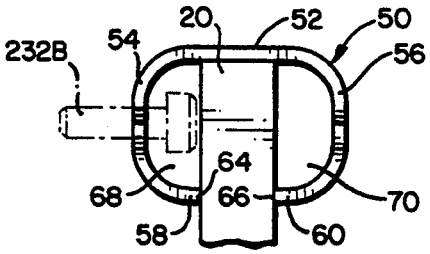
FIG. 8 is a top plan view of the back mounting bracket illustrated in FIGS. 6 and 7.

With reference now especially to FIGS. 4–8, a back mounting bracket 50 is welded to the upper end 30 of the standard 20. The back mounting bracket 50 comprises a substantially C-shaped (facing downwardly as viewed in FIG. 8) channel like member which includes a back wall 52, a pair of side walls 54, 56, and a pair of inwardly directed flanges 58, 60 which form an elongated, forward facing slot 62 (see FIG. 7). The slot 62 permits the back mounting bracket 50 to be pushed over the rearward edge of standard 20 at upper end 30 to the position illustrated in FIG. 4, so that edges 64, 66 of flanges 58, 60, respectively, can be welded to the standard. When the back mounting bracket 50 is welded to the standard 20, a pair of elongated openings 68, 70 are defined on either side of the standard, as best seen in FIG. 8, the significance of which will be explained further herein.

The lower ends of side walls 54, 56 are provided with substantially vertical grooves 72, 74 which open in the downward direction. The upper ends of the side walls 54, 56 are provided with laterally aligned and forward facing cut-outs 76, 78 which include bolt supporting recesses 80, 82, respectively. The manner in which the chair back 18 is secured to a pair of back mounting brackets 50 will be described further herein.

From the above description, it will be appreciated that each frame assembly is fabricated as essentially a one piece unit (which includes the standard 20, floor plate 24, seat mounting bracket 32, arm support 42 and back mounting bracket 50), easily secured to the floor or other supporting surface with conventional fasteners via apertures 28.

It should be understood that each chair seat 16 and back 18 are secured between a pair of standards 20, 22, but that in an auditorium or stadium setting, a large number of chairs are arranged side-by-side with adjacent chairs sharing a common standard 20, brackets 32 and 50 and arm support 42. Thus, the seat bracket 32 is shown to include a single hinge pin extending through the bracket 32, with projecting ends (or hinge pins ) 34, 36, and a single stop pin also extending through the bracket 32, with projecting ends (or stop pins) 38, 40; the back bracket 50 includes the pair of bolt receiving grooves 72, 74 and the pair of bolt receiving recesses or notches 76, 78. In other words, standard 20 will support seat and back components to both sides thereof. However, for the chair located at the end of a row, hinge pin end 34 and stop pin end 38 would be omitted and the back bracket 50 modified to omit side wall 56 and thus groove 74 and cut-out 76. In this regard, it should be noted that the exploded view shown in FIG. 3 illustrates for the sake of clarity and convenience, a seat component 16 adapted for mounting to the left hand side of standard 20, and a back component 18 shown to be mounted to the right hand side of standard 20. The detailed description, however, relates to the mounting of a seat 16 and a back 18 between a pair of standards 20 and 22 as illustrated in FIGS. 1 and 2.

SEAT AND BACK CONSTRUCTION

With reference now to FIGS. 1–3 and 9–14, the seat component 16 in accordance with an exemplary embodiment of the invention includes a one-piece, blow molded shell 84. The shell 84 in a presently preferred embodiment, is formed of a high density polyethylene material, but other suitable plastics may be used as well. The seat shell 84 has upper and lower surfaces 86 and 88 separated by a peripheral side wall 90. A substantial portion of the upper surface of the shell 84 is molded to include variously sized, generally rectangular raised surfaces 92 separated by lower, flat surfaces 94, forming a substantially symmetrical, three dimensional grid pattern area. The lower surfaces 94 are tack molded to the opposite shell surface 88 during blow molding, as shown, for example, in FIG. 12. This, of course, is accomplished using appropriately formed molds and serves to rigidify and strengthen the shell.

The side wall 90 is provided with a pair of elongated integral recessed areas 96, 98 on opposite sides of the shell 84 for receiving elongated steel (or other suitable material of comparable strength) inserts 100, 102 which may be secured within the recessed areas during the molding process.

Figure 12:
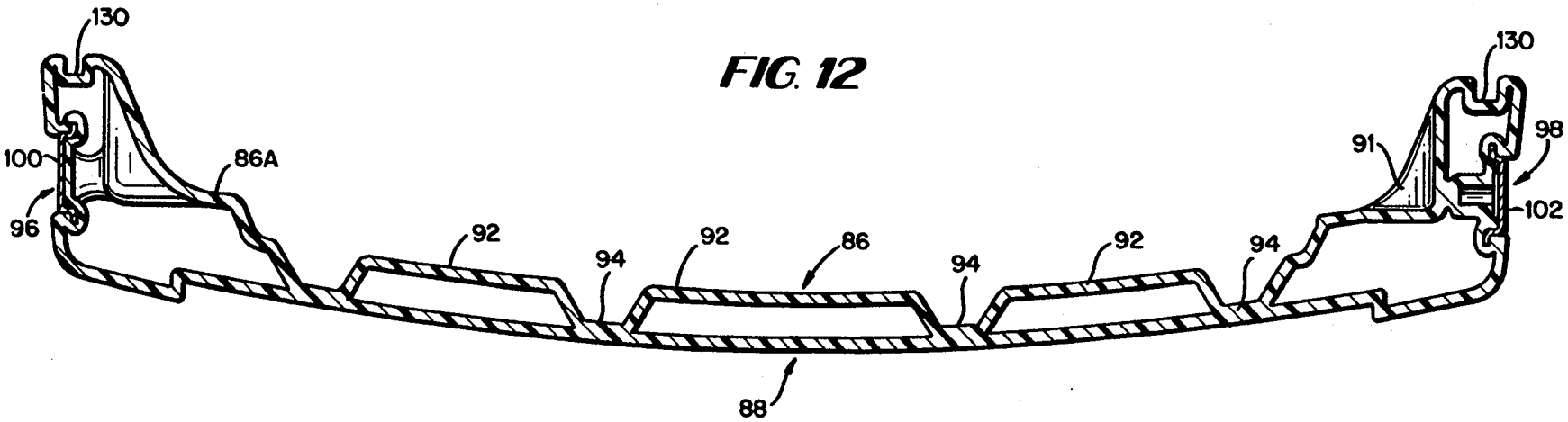
FIG. 12 is a section view of the seat shell illustrated in FIG. 9, taken along the line 12—12.
Figure 14:
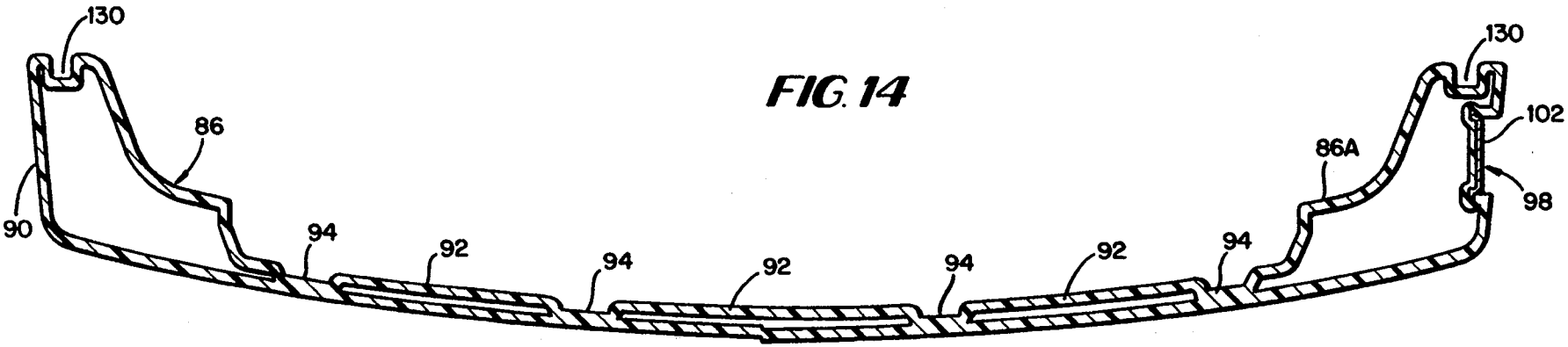
FIG. 14 is a section of the seat shell illustrated in FIG. 9, taken along the line 14—14.

One such insert 102 is shown in detail in FIGS. 15 and 16 and includes an elongated substantially flat body portion 104 with offset flanges 106, 108 extending along opposite sides for a substantial portion of the length thereof. With reference to FIGS. 12 and 14, it will be appreciated that the flanges 106, 108 provide for secure attachment of the inserts to the side wall 90 during molding, in that the plastic material flows around the flanges 106, 108 to lock the insert 102 in place.

With reference again to FIG. 15, the insert 102 is formed with three ¼" dia. holes 110A, B and C, to which are secured by welding or other suitable means, threaded tack nuts 112 which extend rearwardly of the insert (see FIG. 16). The tack weld nuts 112 thus provide good opportunity for tack molding the inner and outer surfaces 90A and 90B of side wall 90 as best seen on the right hand side of FIG. 12, and as also indicated externally by recessed areas 91 in FIGS. 9 and 12.

Returning to FIG. 15, the insert 102 is also provided with four larger holes 114A through 114D (approximately 0.53" in dia.), the purpose for which will be described further below.

Referring now to FIGS. 3, 17 and 18, a steel support bar 116 is shown which is designed for securement to the insert 102. In this regard, seat support bar 116 is provided with three ¼" dia. holes 118A, B and C which may be aligned with holes 110A, B and C of the insert 102 so that seat support bar 116 can be securely attached to the insert 102 in overlying relationship by means of machine screws (not shown) which are threadably received within the tack weld nuts 112.

The seat support bar 116 is also provided with one larger hole 120 of about 0.34" dia. which will overlie hole 114A, and another larger hole 122 of about 0.53" dia. which will overlie hole 114B. Hole 122 is provided with an upset nut 124 which is secured within the hole in the manner of a rivet (see FIG. 18) but is provided with a threaded bore 126 to receive a bolt as explained below.

It will be noted that the relative spacing between holes 114A and 114B is the same as that between holes 114C and 114D. At the same time, the location and relationship of hole 110A to hole 114A is essentially the same as between hole 110C and 114D. Thus, the insert 102 may be secured to the seat shell during the molding process either as shown in FIG. 15 or turned 180° so that hole 114D is on the left side of the insert as viewed in FIG. 15. In other words, the seat support bar 116 will align itself with the holes in the steel insert 102 whether the insert 102 is disposed as shown in FIG. 15 or rotated 180° relative thereto.

The seat support bar 116 is provided with a flanged edge 128 about its entire periphery. Edge 128 serves to space the seat support bar 116 a predetermined distance from insert 102. In FIG. 18A, an alternative seat support bar 116A is shown which has a wider peripheral flanged edge 128A which provides even greater spacing between the support bar 116A and the insert 102. The selection of the particular seat support bar 116 or 116A is determined by the lateral spacing requirements between chairs within a row. By using, or having the capability of using, two differently sized seat support bars, it will be appreciated that a seat shell 84 manufactured from a single mold may be modified to have two effective widths as determined by the depth of the edge flanges 128 and 128A of the seat support bars 116 and 116A. It will further be appreciated that further flexibility may be achieved by producing two different shell widths, using two different molds which, in combination with two differently sized seat support bars, will produce four different chair widths, and so on.

The seat support bar 116 (and an identical seat support bar (117 in FIGS. 1, 2 and 11) on the opposite side of the seat shell 84) are used to mount the seat 16 a pair of standards as described further below. Another advantage to the above described arrangement is the ability to mold the insert 102 in the side wall 90 in a substantially vertical orientation (see FIG. 12) even though the side wall 90 and particularly the side wall surface 90B is inclined from top to bottom. The vertical orientation of insert 102, in turn, allows a vertical orientation for seat support bar 116 which is highly desirable for purposes of mounting the seat.

Another feature of the blow molded shell 84 is the incorporation of an integral groove 130 (see FIGS. 9 and 12–14) which extends about the peripheral edge of the upper surface 86. This groove 130 facilitates the application of upholstery to the upper surface 86 of the seat 16 as will be described further below.

Figure 9:
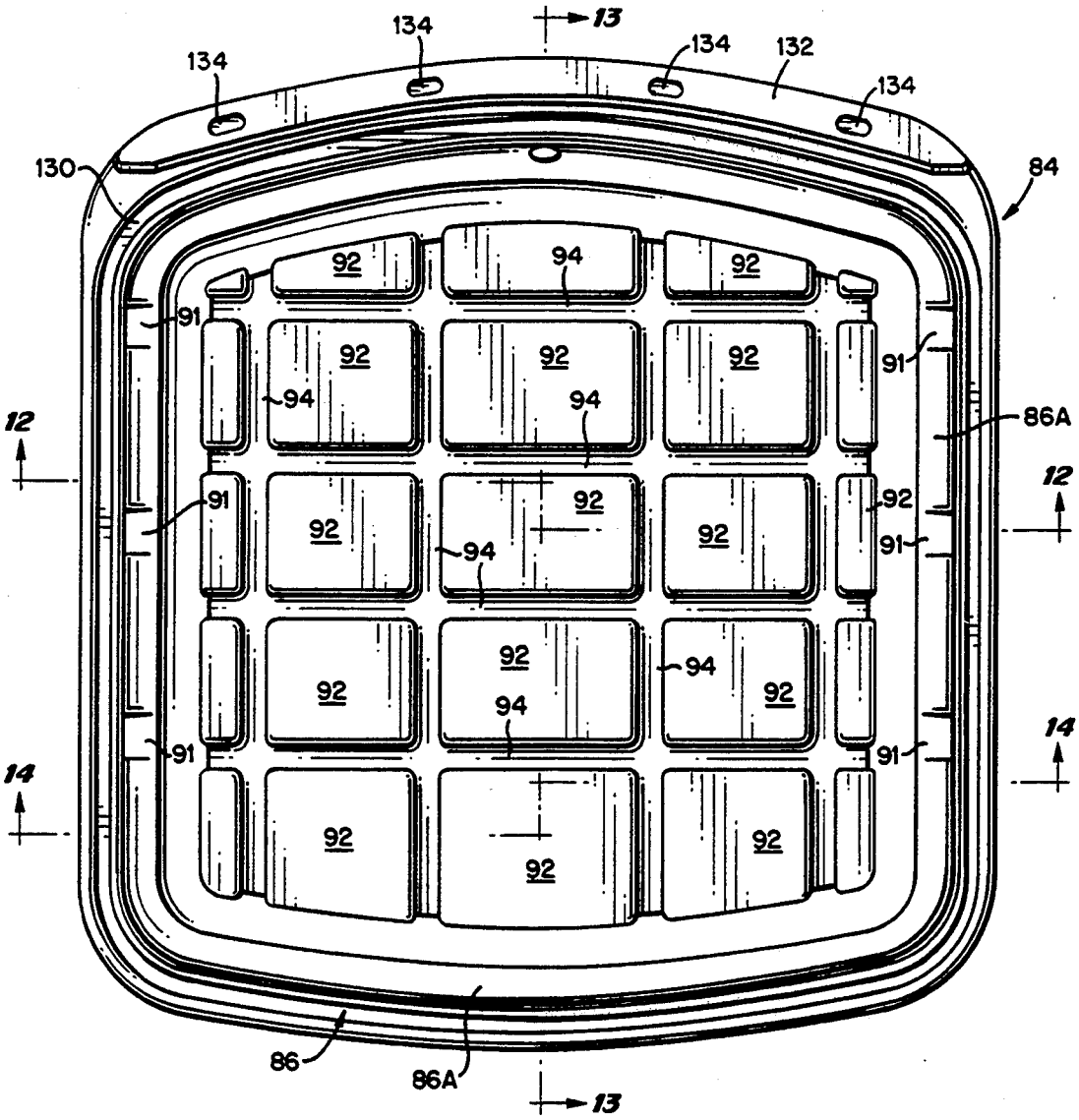
FIG. 9 is a top plan of a seat shell of the type utilized in the chair construction illustrated in FIGS. 1–3.
Figure 10:
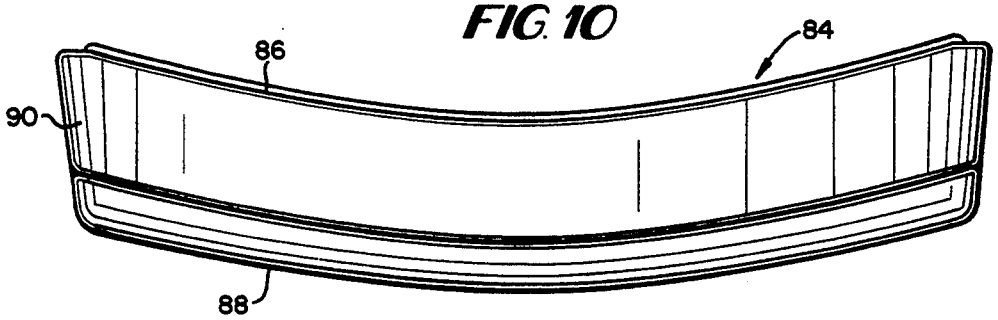
FIG. 10 is a front elevation of the seat shell illustrated in FIG. 9.
Figure 11:
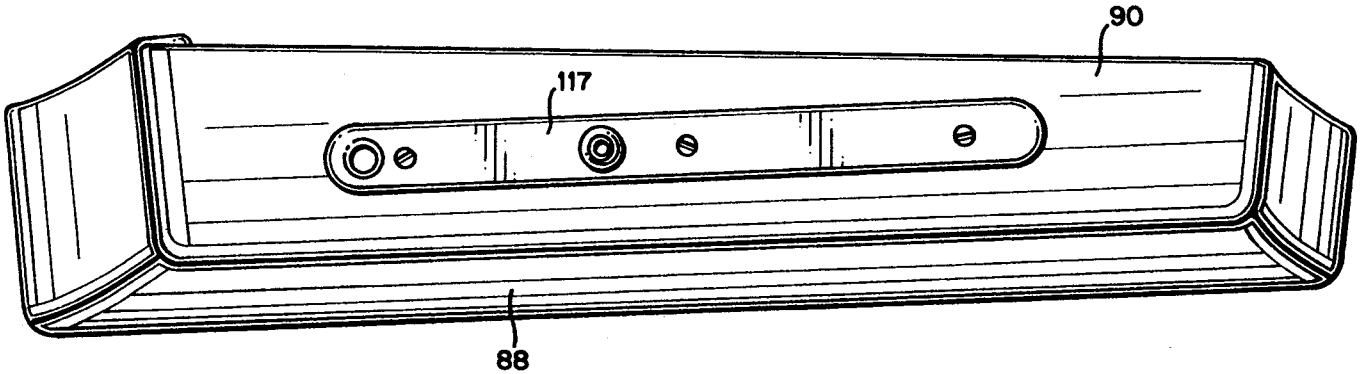
FIG. 11 is a side elevation of the seat shell illustrated in FIG. 9.
Figure 13:
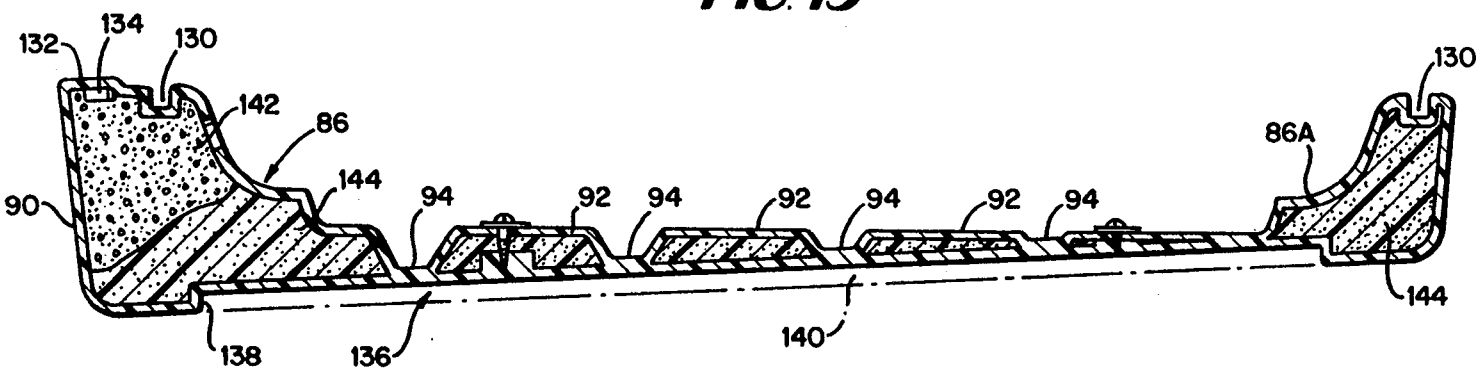
FIG. 13 is a section of the seat shell illustrated in FIG. 9, taken along the line 13—13.

With reference to FIGS. 9 and 13, it should also be noted that a substantially flat shelf 132 is molded at the rear of upper surface 86, and the shelf 132 is formed with four recesses 134 (the number of recesses may vary), the purpose for which also will be described further below.

The lower surface 88 of the seat shell 84 is shown to include a recessed area 136 (see FIGS. 12 and 13) as defined by an inwardly directed wall or edge 138 which is designed to accommodate a decorative wood, fabric or laminate insert panel 140 (shown in phantom) where desired. The panel 140 may be secured by screws from upper surface 86 of the shell so that no fasteners would be visible externally.

In a presently preferred embodiment, a rearward portion of the seat shell 84 interior is counterweighted so that, when the seat 16 is vacated, the seat will swing upwardly to a non-use position, as best seen in FIG. 2. With reference to FIG. 13, the counterweight in the exemplary embodiment is comprised of a particulate material 142 such as magnetite. This material may be loaded into the shell 84, with the latter in an upright position, similar to the above described non-use positions. The amount of material may vary somewhat, but will preferably fill the bottom portion of the shell 84 (when upright) to a level which does not extend beyond the pivot mount location (see FIG. 2). The amount and density of particulate material 142 must be sufficient to cause the seat 16 to swing automatically about the pivot mount location to the non-use position when the seat 16 is vacated. Following loading of the counterweight material 142, a thermosetting foam material 144 is injected into the remaining empty space within the shell 84 (again, with the shell in an upright position). In this way, the foam 144 compresses and confines the particulate material 142 to the desired area within the shell 84. It is noted that, for simplicity, the particulate material 142 and foam 144 are omitted from FIGS. 12 and 14.

While the presently preferred material 142 is magnetite, other particulate material may also be used, so long as the density is sufficient to create the required weight. The density should be at least as great as that for sand in order to achieve the desired results.

Figure 19:
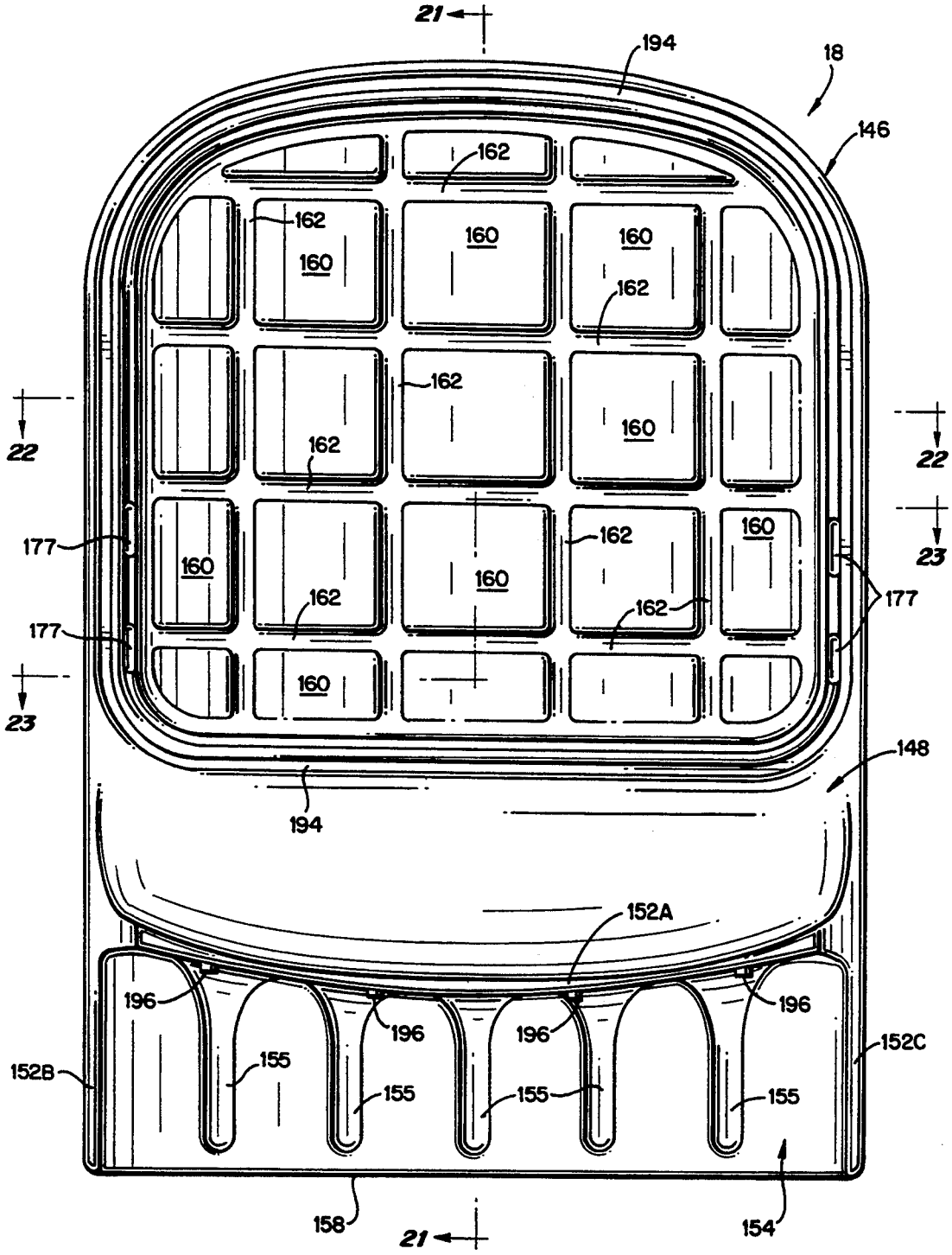
FIG. 19 is a front elevation of a back shell of the type utilized in the chair construction illustrated in FIGS. 1–3.
Figure 20:
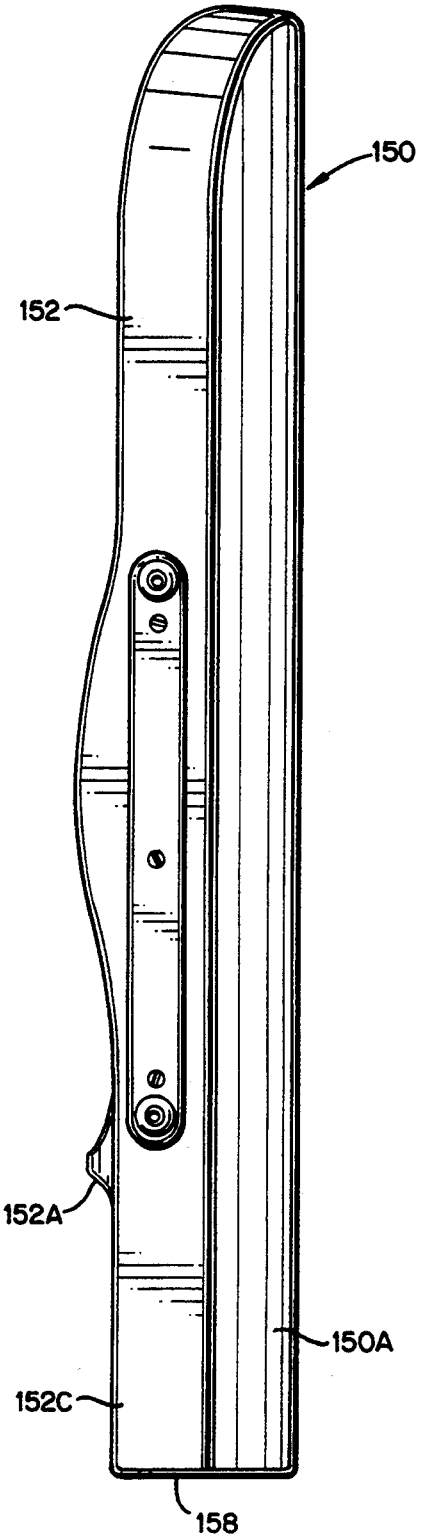
FIG. 20 is a side elevation of the back shell illustrated in FIG. 19.

With reference now to FIGS. 19–23, the back component 18 in accordance with an exemplary embodiment of the invention is formed in a manner similar to that of the seat component 16. Thus, the back component 18 includes a one-piece, blow molded shell 146, also preferably formed of high density polyethylene material, and including front and rear surfaces 148, 150 separated by a peripheral side wall 152, 152A. The shell 146 also has a lower extended portion 154 which extends downwardly beyond a transverse side wall portion 152A as best seen in FIGS. 17 and 19. In other words, the extended portion 154 is defined by the transverse wall 152A and extended side wall portions 152B and C and an extended rear surface portion 150A terminating at a lowermost edge 158. Since this extended portion 154, (which includes vertical reinforcing ribs 155) of the back component 18 does not have a front surface, a forward facing recess is formed (see FIG. 19) which receives the seat component 16 in a manner to be described further herein.

Like the seat component 16, a substantial portion of the front surface 148 of the shell 146 is molded with variously sized, generally rectangular raised surfaces 160 separated by lower flat surfaces 162 to form a three dimensional grid-like pattern area. As will be appreciated from the sectional views in FIGS. 20 and 21, the height of the raised surfaces 160 relative to the rear surface 150 of the shell 146 varies from the upper portion of the shell toward the lower portion of the shell as also seen in FIG. 19. Here again the lower surfaces 162 are tack molded to the rear surface 148 during the blow molding process.

The side wall 152, like side wall 90 of the seat component 16, is provided with a pair of integral recessed areas 164, 166 (see FIG. 23) on opposite sides of the shell 146 for receiving elongated steel inserts 168, 170 which are secured within such recessed areas 164, 166 during the molding process.

Figure 23:
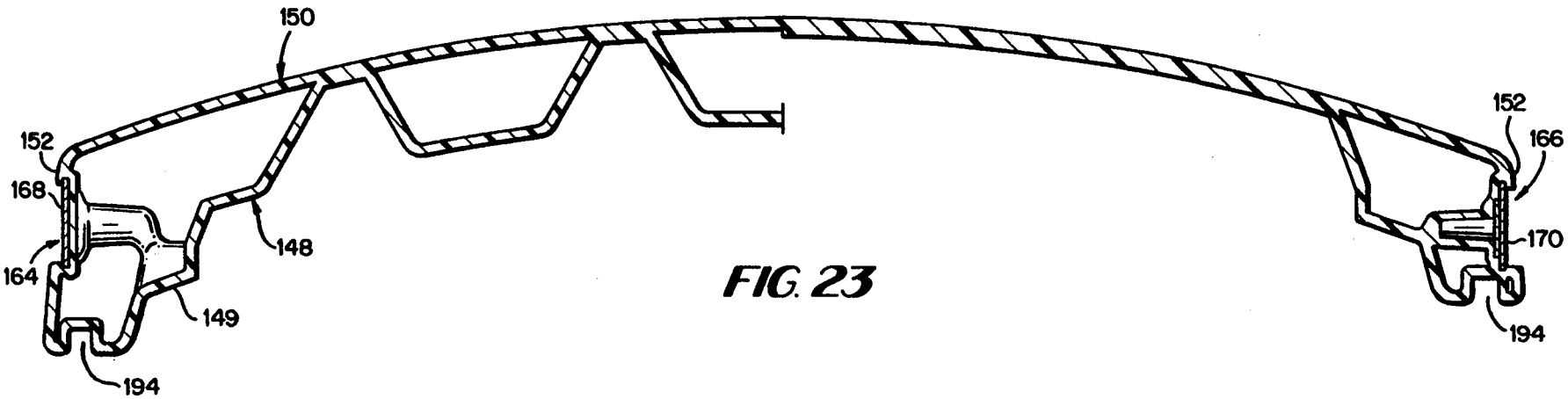
FIG. 23 is a partial section of the back shell illustrated in FIG. 19 and taken along line 23—23.
Figures 24, 25, 26, 27, 27A, 34, 35:
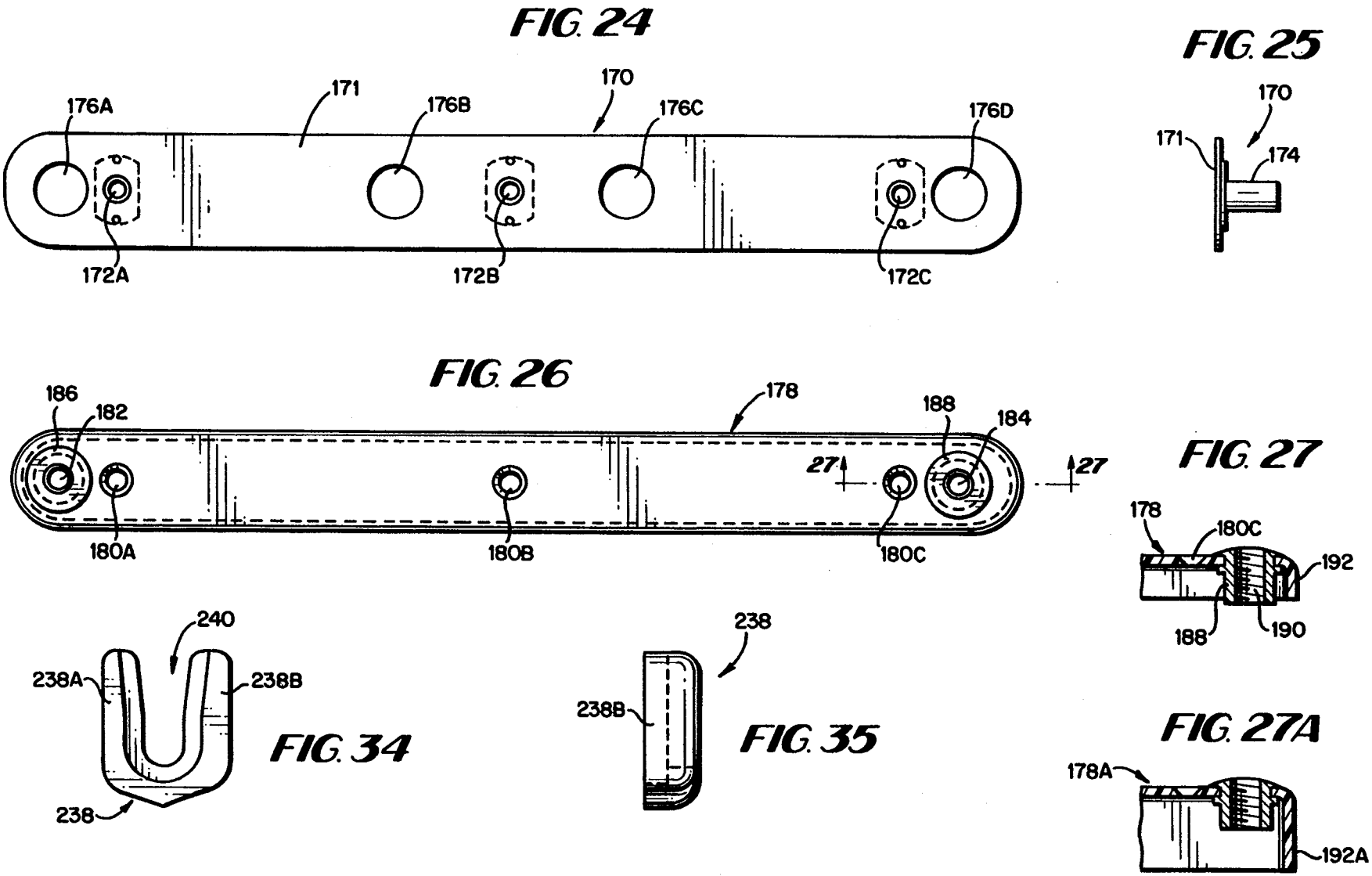
FIG. 24 is a side elevation of a back component insert in accordance with the invention.
FIG. 25 is an end view of the back insert illustrated in FIG. 24.
FIG. 26 is a side elevation of a back support bar in accordance with an exemplary embodiment of the invention.
FIG. 27 is a partial section of the back support bar illustrated in FIGS. 26, and taken along the line 27—27.
FIG. 27A is a partial section of a back support bar in accordance with an alternative embodiment of the invention.
FIG. 34 is a side elevation of a locking element in accordance with an exemplary embodiment of the invention.
FIG. 35 is a side elevation of the locking element illustrated in FIG. 34.

One such insert 170 is shown in detail in FIGS. 24 and 25 and includes an elongated, substantially flat body portion 171 provided with three ¼" diameter holes 172A, B and C to which are secured by welding or other suitable means, threaded tack nuts 174 which extend rearwardly of the insert (see FIG. 23). These tack weld nuts 174, like the previously described tack weld nuts 112, provide an opportunity for tack molding the inner and outer, laterally spaced surfaces of the side wall 152 as best seen in FIG. 23.

Returning to FIGS. 24 and 25, the insert 170 is also provided with four larger holes 176A–D (each approximately 0.53" in diameter), the purpose for which will be described further below. While holes 176A and 176D have specific functions with respect to fastening hardware used to connect the back 18 to the frame assemblies, all of holes 176A, B, C and D permit mold pins (not shown) to be inserted within the peripheral side wall 152 of the shell 146 in order to provide additional internal tack molded areas as partially indicated by recesses 177 in FIG. 19.

With specific reference to FIGS. 26 and 27, a steel back support bar 178 is shown which is designed for securement to the insert 170. The back support bar 178 is thus provided with three ¼" diameter holes 180A, B and C which may be aligned with holes 172A, B and C of the insert 170 so that the back support bar 178 can be securely attached to the insert 170 in overlying relationship by means of machine screws (not shown) which are threadably received within the tack weld nuts 174.

The back support bar 178 is also provided with a pair of larger holes 182, 184 at opposite ends thereof. Both of these holes 182, 184 are provided with upset nuts 186, 188, each having threaded bores (one shown at 190 in FIG. 27). Both upset nuts 186, 188 are adapted to receive bolts as explained further below, and these bolts may extend into holes 176A, 176D as necessary.

With reference to FIG. 27, it will be appreciated that the back support bar 178 is provided with a flanged edge 192 about its periphery. This edge 192 serves to space the back support bar 178 a predetermined distance from the insert 170. In FIG. 27A, an alternative back support bar 178A is shown which has a wider peripheral flanged edge 192A which provides even greater spacing between the support bar 178A and the insert 170. Here again, as in the case of the seat component 16, the selection of particular back support bars 178, 178A is determined by the lateral spacing requirements between chairs within a row, and provides great flexibility with respect to effective chair widths and spacing therebetween.

The back support bar 178, and an identical back support bar on the opposite side of the back shell 146 are used to mount the back 18 to the pair of standards 20, 22 as described further below.

As in the case of the seat shell 86, the manner in which the steel inserts 168, 170 and back support bars 78 are secured to the shell 146 allows inserts 168 and 170 as well as their associated bars 178 to be arranged vertically to facilitate mounting of the back component 18, even though the side wall portions 152 in the area of the inserts 168, 170 may be inclined relative to a vertical plane.

The blow molded shell 146 is also formed with an integral groove 194 (see FIGS. 19 and 21–23) which encloses the patterned area of the shell 146 and facilitates the application of upholstery to the front surface 150 of the back 18 as described further below.

Figure 21:
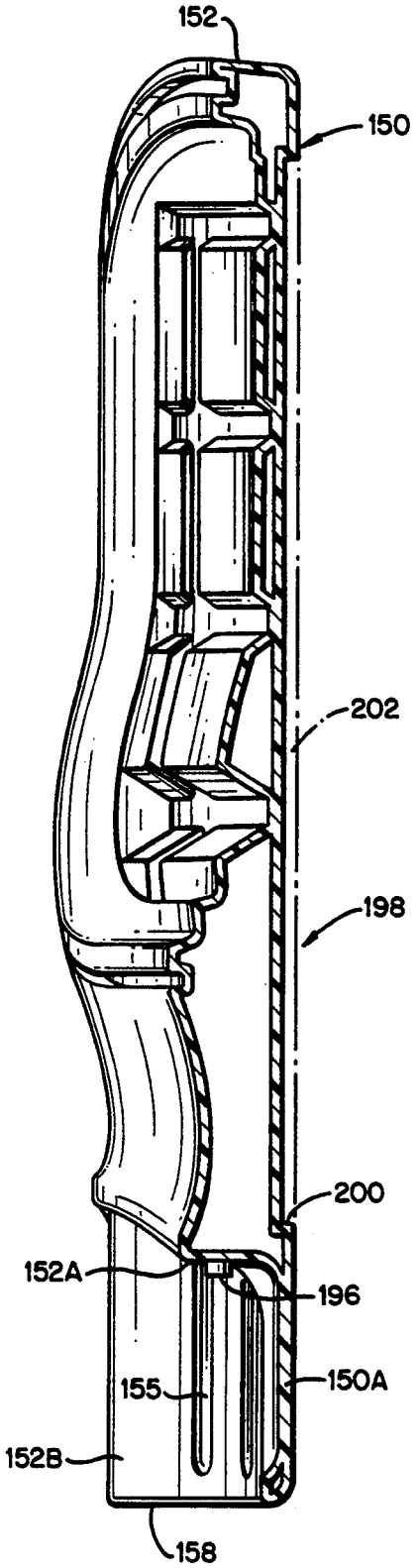
FIG. 21 is a side section of the back shell illustrated in FIG. 19, taken along line 21—21.

With reference specifically to FIGS. 19 and 21, the transverse wall 152A is formed with four downwardly projecting tabs 196 which will seat within the recesses 134 provided on the flat shelf surface 132 of the seat component 16 when the latter is rotated to its in use or horizontal position. This arrangement serves to lock the seat component 16 to the back component 18 during the use of the chair and thus strengthens and rigidifies the chair as a whole, preventing relative movement of the seat 16 relative to the back 18 in either a forward to backward or side-to-side direction. The arrangement also permits loading applied to one component to be taken up at least in part by the other.

Figure 22:
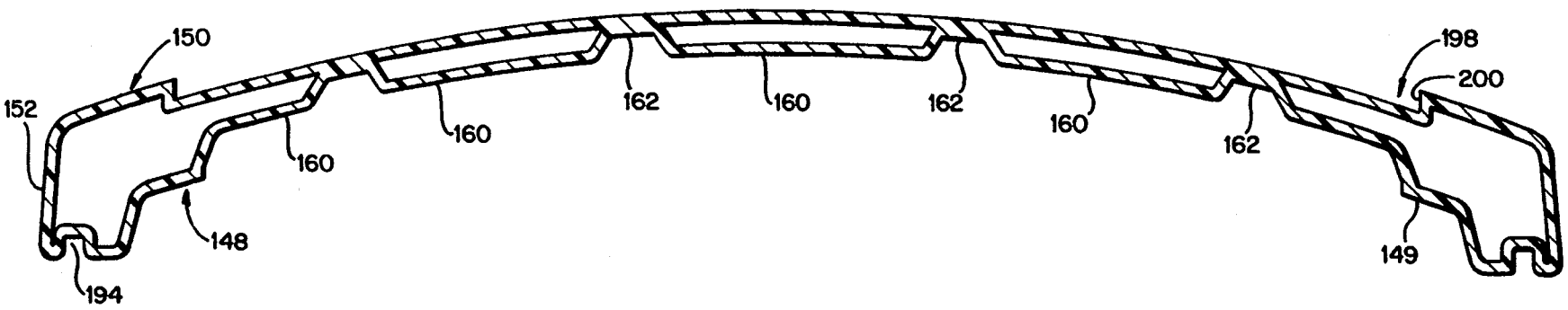
FIG. 22 is a section of the back shell illustrated in FIG. 19 and taken along line 22—22.

With reference to FIGS. 21 and 22, the rear surface 148 of the back shell 146 may be formed with a recessed area 198 defined by an inwardly directed wall or edge 200 which will accommodate a decorative wood, fabric or laminate insert panel 202 (shown in phantom in FIG. 19). This optional panel would preferably match the panel 140 in the lower side of the seat component 16. Here again, the panel 202 would be secured by screws from the front surface of the shell 146 so that no fasteners would be visible externally from behind the chair.

The above described seat and back construction provides increased strength and load bearing capability in excess of 600 pounds. The construction also has the advantage of fewer moving parts and reduced maintenance.

THE HINGE

A pair of hinges 204, 204A (see FIG. 2) are employed for the purpose of mounting the seat component 16 to the pair of standards 20, 22, and specifically to the hinge pin ends 34, 36 welded to the plates 32.

Since the hinges 204, 204A are formed identically but when installed are mirror images of each other, only one need be described. With specific reference to FIGS. 28–31, the hinge 204 is generally tear-drop shaped, having rounded surfaces at a relatively narrower end 206 and a relatively wider end 208. The hinge is injection molded plastic (preferably a polymer such as nylon but other material such as aluminum could be employed), and is formed with opposite side surfaces 210, 212 connected by an integral end wall 214. Side surface 210 is formed with recessed or cut-out area 216 reinforced by ribs 218 which intersect at a threaded bore 220 in the narrower end 206 of the hinge. The opposite side surface 212 is formed with a circular recess or cut-out 222 in the wider end 208 of the hinge, with reinforcing ribs 224 intersecting to form a round bushing 226 defining a smooth bore 228. The smooth bore 228 is designed and dimensioned to slide over the pivot pin end 36 so as to be freely rotatable about the pin end. The plastic bushing 226 thus provides self "lubrication" at the interface of the bore 228 and pin end 36, thereby providing smooth, silent operation.

The reinforcing ribs 224 form, within the cut-out 222, a pair of recess 225 one of which receives the stop pin 40. By reason of the angular offset of the hinge pin 34 relative to the stop pin 40, and further by reason of the length of the recesses 225, when the hinge 204 is secured to the seat 16 in the manner described below, the seat is free to rotate between a substantially horizontal use position illustrated in FIG. 1, approximately 90° to the non-use position illustrated in FIG. 2 with the stop pin 40 serving to limit rotation of the seat (via abutment with a rib 224) so that it will rotate no further than illustrated in FIG. 2.

The enlarged end 208 of the hinge 32 is provided with a T-shaped slot 230 in end wall 214—which opens upwardly (or radially outwardly relative to bore 228). The slot opens in surface 210 so that a bolt head 234 (see FIG. 32) can be received in slot 230 with the shank of the specially designed bolt 232 extending out of and away from surface 210 (see FIG. 3).

SEAT MOUNTING ARRANGEMENT

Figure 32:
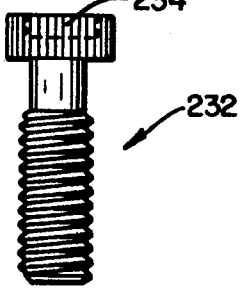
FIG. 32 is a side elevation of a bolt for use in the mounting of the seat and back components to the frame assemblies in accordance with the invention.
Figure 33:
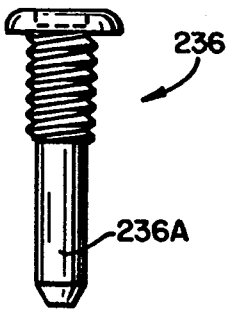
FIG. 33 is a side elevation of a bolt for use in the assembly of the hinge to the seat in accordance with an exemplary embodiment of the invention.
Figure 31:
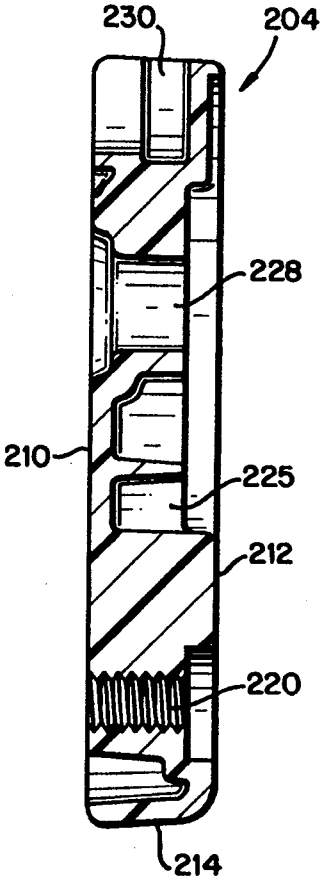
FIG. 31 is a side section of the hinge illustrated in FIG. 9, and taken along the line 31—31.
Figure 29:
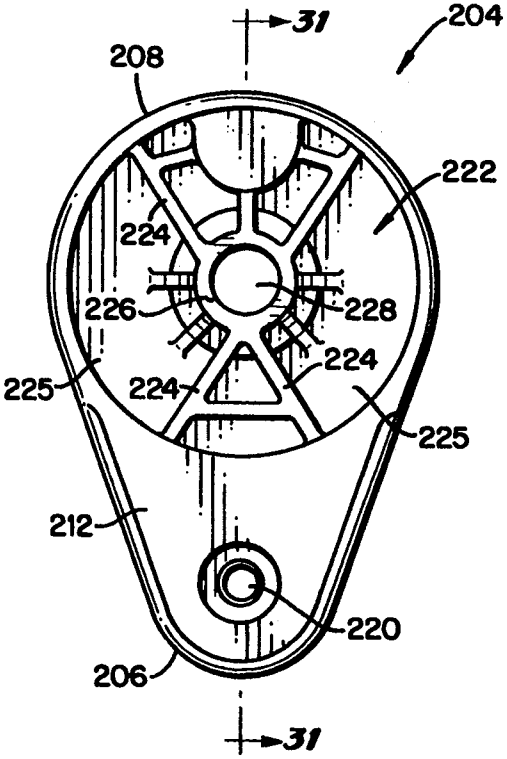
FIG. 29 is a right side elevation of the hinge illustrated in FIG. 3.
Figure 28:
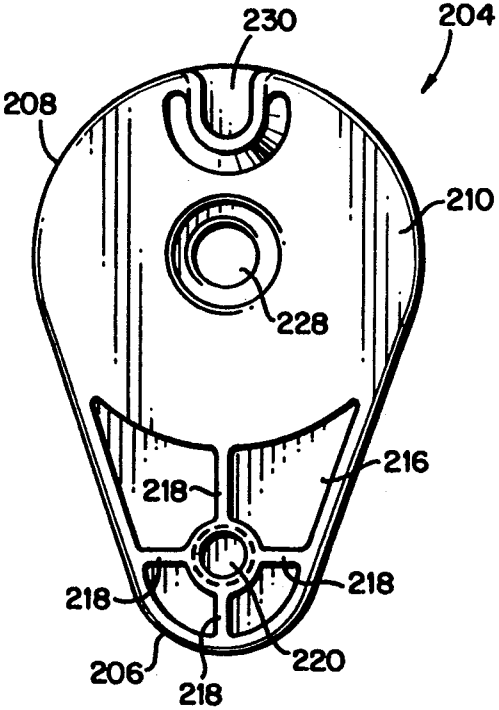
FIG. 28 is a left side elevation of the hinge illustrated in FIG. 3.

To mount a seat component 16 to a pair of standards 20, 22, a bolt 232 of the type shown in FIG. 32 (and an identical bolt on the opposite side of the seat) is threadably secured to the upset nut 124 in the seat support bars 116, 117 and adjusted to provide the required spacing between the seat 16 and an associated hinges 204, 204A. In this regard, it is within the scope of this invention that bolts 232 be fixed to the seat component so that while adjustable, they would be prevented from being removed. With the hinges 204, 204A received over hinge pin ends 34, 36 (of adjacent standards 20, 22) and rotated to present the T-slot 230 upwardly, and with stop pin ends 38, 40 located in recesses 225, the seat 16 (also oriented as shown in FIG. 3) is simply "dropped" into place with the heads 234 of bolts 232 disposed within the T-slots 230. Then, partially threaded bolts 236 (FIG. 33) are screwed into bores 220 in the pair of hinges 204, 204A so that the smooth shank portions 236A protrude inwardly for sliding engagement within holes 120 and 114A of the seat support bar 116 and insert 102, respectively (and similar holes in support bar 117 and insert 100). This completes the seat mounting, and it is significant that mounting of the seat between standards 20, 22 requires only two fasteners 236 for fixing the seat in place. In addition, it is to be noted that the hinges 204, 204A are not placed in compression but remain relatively free floating with respect to the seat component and adjacent standards.

BACK MOUNTING ARRANGEMENT

To secure the back component 18 to the pair of frame standards 20, 22, bolts similar to those shown at 232 in FIG. 32 are screwed into upset nuts 186, 188 of back support bars 168, 170 and adjusted to provide the required lateral spacing. Here again, these bolts can be secured to the back 18 to retain the lateral adjustability feature but to prevent separation. The back component 18 is then located between the standards 20, 22 so that lower bolts 232A (see FIG. 3) may be drawn up into the open ended grooves 72, 74. When the bolts 232A are fully inserted within the grooves 72, 74, the back 18 may be rotated rearwardly toward the standards 20, 22 so that upper bolts 232B are received within cut-out recesses 80, 82 in the back mounting brackets 50. It will thus be appreciated that the recesses 80, 82 receive substantially the entire vertical loading of the back 18, while grooves 72, 74 merely serve to preclude any backward or forward movement of the back relative to the brackets 50. When in place, a pair of inverted U-shaped nylon locking elements 238 (see FIGS. 34 and 35) are slipped into the upper open end of the brackets 50 (see FIG. 8) so that bolts 232B received within the central grooves or recesses 240 in the nylon locking elements, and legs 238A and B extend downwardly into openings 68, 70 on either side of the standard. This arrangement locks the back component 18 to the frame standards 20, 27 with the back 18 "hung" onto the brackets 50, with no need for any additional fasteners.

ARM INSTALLATION

Figure 36:
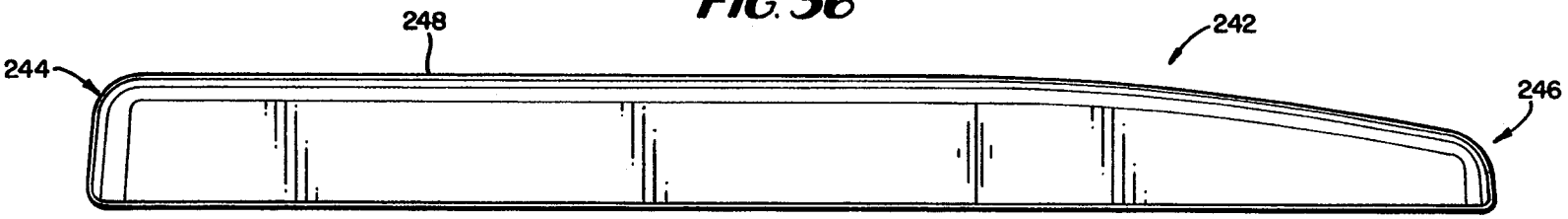
FIG. 36 is a side elevation of an arm rest of the type utilized in the chair construction illustrated in FIGS. 1–3.
Figure 37:
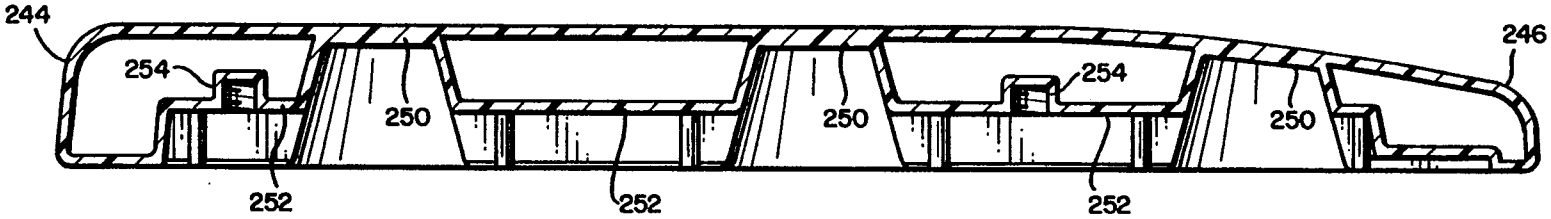
FIG. 37 is a side section view of the arm rest illustrated in FIG. 36.
Figure 38:
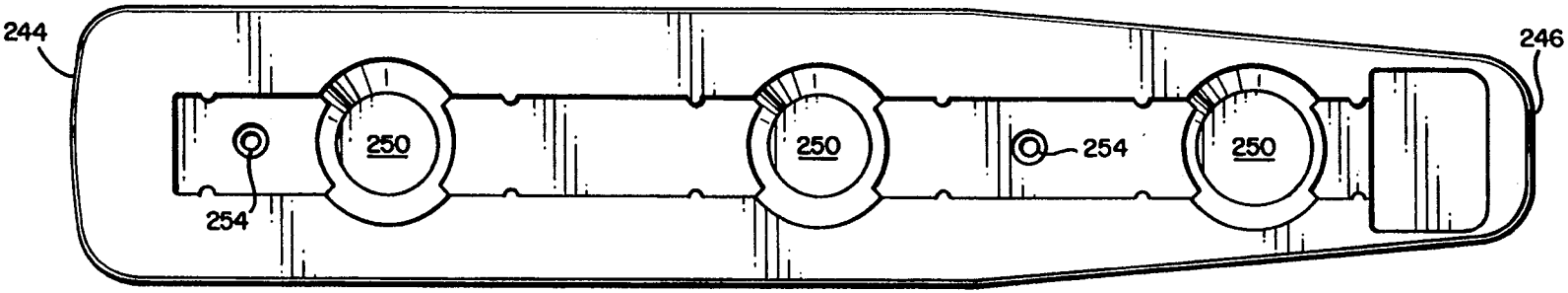
FIG. 38 is a bottom plan view of the arm rest illustrated in FIG. 36.
Figure 41:
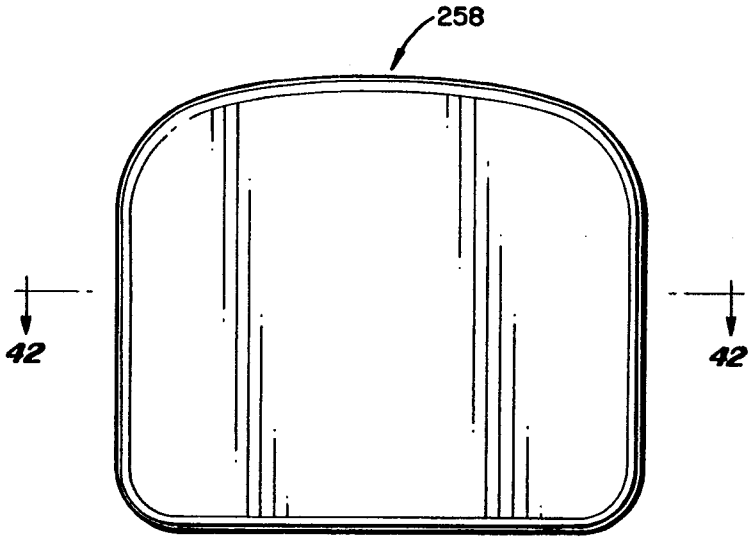
FIG. 41 is a front elevation of a seat cushion of the type illustrated in the chair construction of FIGS. 1–3.
Figure 42:
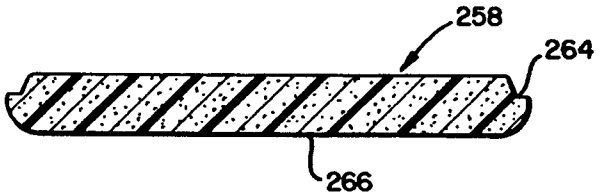
FIG. 42 is a section view of the cushion illustrated in FIG. 41 and taken along line 42—42.
Figure 39:
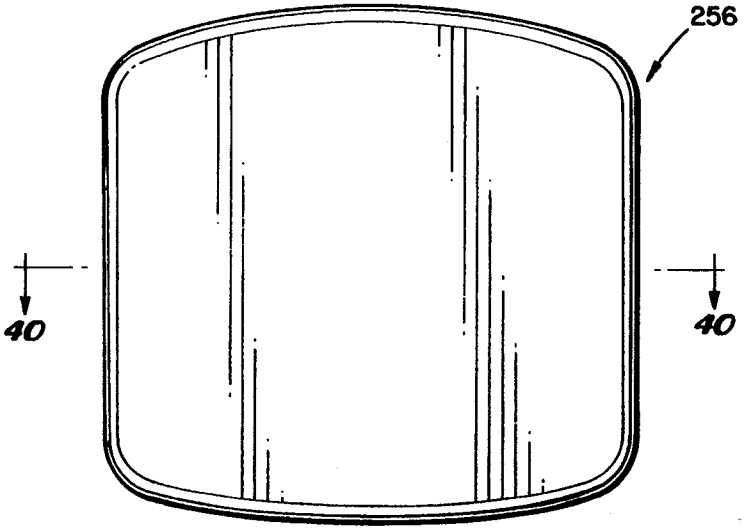
FIG. 39 is a plan view of a seat cushion of the type utilized in the chair construction shown in FIGS. 1–3.
Figure 40:
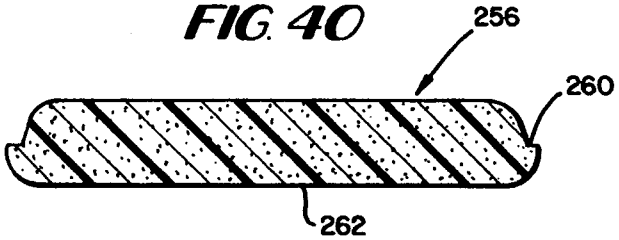
FIG. 40 is a cross section of the seat cushion illustrated in FIG. 39 and taken along the line 40—40.

With reference to FIGS. 36–38, an arm rest component 242 is shown in accordance with an exemplary embodiment of the invention. The arm rest 242 is formed with a forward facing end 244 and a rearward facing end 246. The arm itself is formed as a one-piece molded plastic part with an external arm rest surface 248, and an internal reinforcing structure which includes tack welded portions 250 and substantially horizontal web portions 252 which extend substantially parallel to upper and lower surfaces of the arm. Within the horizontal web surfaces 252 are provided a pair of threaded bushings 254 which are adapted to receive threaded fasteners extending through the apertures 45 in the base 44 of each arm support bracket 42. Typically, the arm rests 242 will be secured to the arm support brackets 42 at the installation site.

UPHOLSTERY

Cushions and upholstery are applied to the shell 84 of seat 16 and shell 146 of back 18 in a simple, easy manner. It will be appreciated that the cushion and upholstery material will be assembled to the shells 84, 146 at the factory, prior to installation. It will also be appreciated that it is not necessary to in any way disturb the upholstery during the above described installation process.

With reference to FIGS. 39–42, the shells 84 and 146 are adapted to receive cushions 256 and 258, respectively, of suitable foam material (with no springs) directly by means of adhesive, on their respective upper and front surfaces 86, 148. Cushion 256 will be adhesively secured to surface 86 in the areas 92 of the grid pattern, and a shoulder 260 will rest on relatively flat surface portion 86A, so that the upper surface 262 of the cushion 256 will lie adjacent and above the peripheral groove 130. Similarly, cushion 258 will be adhesively secured to raised surfaces 160 of the grid formed in surface 148 with shoulder 264 seated on surface 149 (see FIGS. 22 and 23) so that the upper surface 266 cushion will be adjacent and above the peripheral groove 194.

Figure 43:
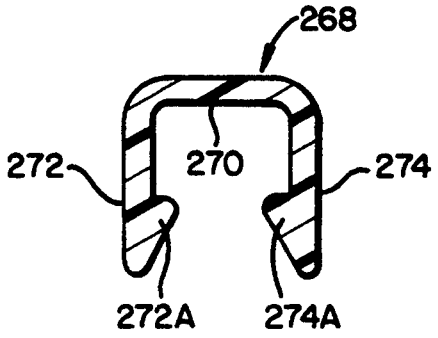
FIG. 43 is a section of an elongated female strip of a type utilized to secure upholstery to the seat and back shells in accordance with an exemplary embodiment of the invention.
Figure 44:
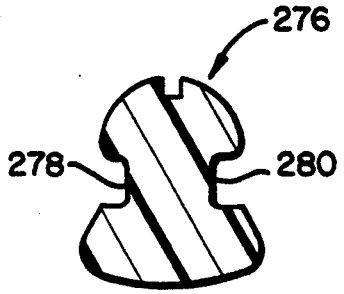
FIG. 44 is a section of an elongated male strip for press fit engagement within the strip illustrated in FIG. 43 in accordance with the invention.

A selected fabric is then laid over the cushions 258, 260 and pressed into place within the grooves 130, 194. Flexible, female strips 268 (see FIG. 43) of rubber or polymer material are laid in grooves 130, 194, with the base 270 of the strips flush with the bottom of the grooves. In other words, the barbed side walls 272, 274 face upwardly. The fabric material is then stapled to the components 16 or 18 at predetermined intervals through the base surface 270 of the strip. A male strip 276 (FIG. 44) is then inserted into strip 268 so that barbs 272A, 274A are resiliently secured within recesses 278, 280 to thereby hold the male strip 276 in place and also hide the staples from view.

Figure 45:
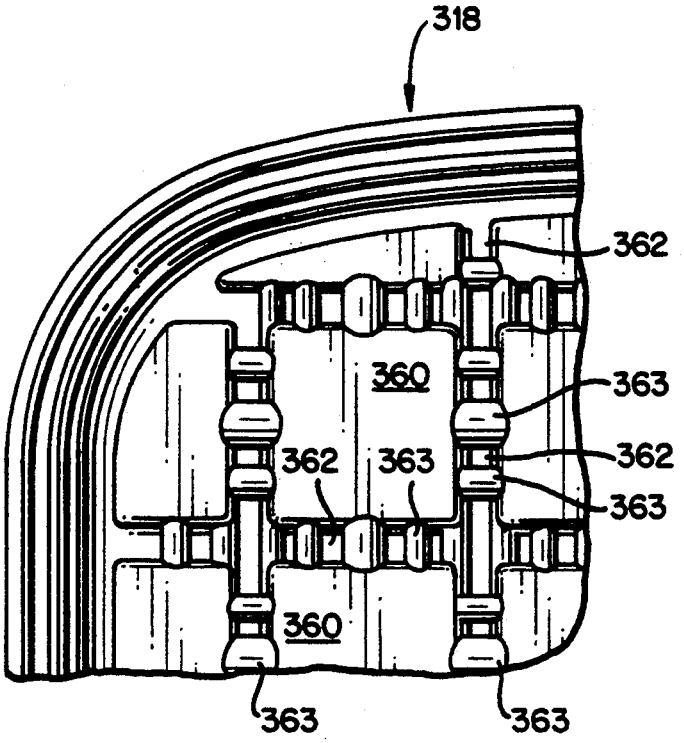
FIG. 45 is a partial front elevation of a back shell in accordance with another exemplary embodiment of the invention.

Finally, with reference to FIG. 45, it will be appreciated that various grid patterns may be molded into the seat 16 and/or back 18. Thus, FIG. 45 illustrates a back component 318 which is formed with a plurality of raised surfaces 360 separated by depressed flat surfaces 362. However, in this embodiment, additional raised ribs 363 interconnect the various raised surfaces 360 to create additional air spaces within the blow molded shell. It is believed that by increasing the air spaces between the front and back surfaces of the shell, it is less likely that a faint imprint of the grid pattern will appear externally on the back surface of the shell. It will be readily appreciated, however, that many other patterns can be molded into the seat or back shell without departing from the spirit and scope of this invention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A chair comprising:

a frame including a pair of standards each including a seat mounting bracket and a back mounting bracket, each seat mounting bracket having a hinge pin; a seat component pivotally mounted on a pair of said hinge pins by means of a pair of hinges, each hinge comprising a main body portion freely rotatably mounted on one of said hinge pins, said main body portion also formed with a slot for receiving a bolt head of a first bolt threadably secured to said seat component.

2. The chair of claim 1 wherein said body portion includes a through bore adapted to receive said hinge pin, and a threaded aperture for receiving a second, partially threaded bolt, a smooth shank portion of which extends into an aperture provided in said seat component.

3. The chair of claim 2 wherein said seat component is formed as a unitary plastic shell having an upper surface, lower surface and peripheral end wall, said peripheral end wall formed with a pair of metal mounting assemblies, at least a portion of which is integrally molded within said peripheral end wall on opposite sides of said seat component, and wherein said first bolt is threadably and adjustably secured within said metal mounting assembly, and further wherein said metal mounting assembly is provided with at least one aperture for receiving said smooth shank portion of said second bolt.

4. The chair of claim 2 wherein said slot and said aperture are formed on either side of, and are substantially aligned with said through bore.

5. The chair of claim 1 wherein said hinge is constructed of a polymer.

6. The chair of claim 1 wherein said seat mounting bracket further comprises a stop pin extending substantially parallel to said hinge pin, and wherein said hinge is formed with a recess shaped and configured to receive said stop pin and to permit rotation of said hinge and said seat component through about 90°.

7. The chair of claim 1 wherein said seat component is formed as a unitary plastic shell having an upper surface, lower surface and peripheral end wall, said peripheral end wall formed with a pair of metal mounting assemblies, at least a portion of which is integrally molded within said peripheral end wall on opposite sides of said seat component, and wherein said first bolt is threadably and adjustably secured within said metal mounting assembly.

8. The chair according to claim 7 wherein each of said metal mounting assemblies includes a first insert molded in place within said peripheral end wall and a seat support bar secured to said insert in overlying relationship, said first bolt being threadably secured within said seat support bar.

9. A chair comprising:

a frame including a pair of back mounting brackets and a pair of seat mounting brackets, said pair of back mounting brackets having upper and lower ends:

a seat component mounted on and between said seat mounting brackets; and a back component mounted on and between said back mounting brackets wherein said back component includes an upper pair of laterally extending mounting pins and a lower pair of laterally extending mounting pins, said pair of back mounting brackets having surfaces at said upper end for receiving said pair of upper mounting pins in a substantial vertical load bearing relationship such that said back component is hung on said frame, and wherein said lower ends are provided with substantially vertical grooves open in a downward direction for receiving said lower pair of mounting pins to thereby prevent forward and backward movement of said back component.

10. The chair of claim 9 wherein said surfaces at said upper ends of said back mounting brackets include rearwardly open recesses for receiving said upper pair of mounting pins.

11. The chair of claim 10 wherein said back mounting brackets each comprise a channel member welded to said frame to create a substantially vertical passageway extending between said upper and lower ends of said mounting brackets, and wherein said upper and lower pair of mounting pins extend transversely of said passageway when said back is hung on said frame.

12. The chair of claim 11 and further including a removable locking element slidably received in each said passageway and configured to at least partially surround said upper pair of mounting pins to thereby releasably secure said upper pair of mounting pins within said recesses of said back mounting brackets.

13. The chair of claim 9 and wherein said upper and lower mounting pins are laterally adjustable relative to said back component.

14. The chair of claim 13 wherein said upper and lower mounting pins each comprise a threaded bolt having an enlarged head.

15. A chair comprising:

a frame including a pair of back mounting brackets and a pair of seat mounting brackets;

a seat component mounted on and between said seat mounting brackets; and a back component mounted on and between said back mounting brackets wherein said back component includes an upper pair of laterally extending mounting pins and a lower pair of laterally extending mounting pins, said pair of back mounting brackets having surfaces for receiving said pair of upper mounting pins in a substantial vertical load bearing relationship such that said back component is hung on said frame, and wherein said seat mounting brackets each include an inwardly facing hinge pin; and further wherein a hinge element is provided for slidable mounting on each said hinge pin, each of said hinge elements having a pair of apertures for two point attachment to said seat component.

16. The chair of claim 15 wherein said hinge elements are freely rotatable on said hinge pins.

17. The chair of claim 9 wherein said seat component includes a counterweight for automatically moving said seat component from an in use to a non use position when vacated.

18. A chair comprising:

a frame including a pair of back mounting brackets and a pair of seat mounting brackets;

a seat component mounted on and between said seat mounting brackets; and a back component mounted on and between said back mounting brackets wherein said back component includes an upper pair of laterally extending mounting pins and a lower pair of laterally extending mounting pins, said pair of back mounting brackets having surfaces for receiving said pair of upper mounting pins in a substantial vertical load bearing relationship such that said back component is hung on said frame;

wherein said seat component includes a counterweight for automatically moving said seat component from an in use to a non use position when vacated; and wherein said seat component comprises a substantially hollow plastic shell and said counterweight comprises particulate material confined to a predetermined portion of said shell.

* * * * *